US005517467A

United States Patent [19]

Fromont et al.

[11] Patent Number: 5,517,467

[45] Date of Patent: May 14, 1996

[54] UNDERSEA ACOUSTIC ANTENNA WITH SURFACE SENSOR

[75] Inventors: Bernard Fromont, Contes; Robert Fichaux, Le Rouret, both of France

[73] Assignee: Thomson-CSF, Paris, France

[21] Appl. No.: 325,432

[22] PCT Filed: May 7, 1993

[86] PCT No.: PCT/FR93/00444

§ 371 Date: Nov. 7, 1994

§ 102(e) Date: Nov. 7, 1994

[87] PCT Pub. No.: WO93/24244

PCT Pub. Date: Sep. 9, 1993

[30] Foreign Application Priority Data

May 22, 1992 [FR] France ..... 92 06274

[51] Int. Cl.[6] ..... H04R 17/00

[52] U.S. Cl. ..... 367/155; 310/337; 310/800; 367/162; 367/165; 367/166

[58] Field of Search ..... 367/141, 149, 367/153, 155, 156, 157, 162, 164, 165, 166, 173, 176; 310/337, 800

[56] References Cited

U.S. PATENT DOCUMENTS

| | | | |
|---|---|---|---|
| 1,391,681 | 9/1921 | Hahnemann et al. | 367/173 |
| 4,319,716 | 3/1982 | Lauer | 310/323 |
| 4,399,526 | 8/1983 | Eynck | 367/153 |
| 4,450,544 | 5/1984 | Denaro et al. | 367/153 |
| 4,694,440 | 9/1987 | Ogura et al. | 367/157 |
| 4,745,584 | 5/1988 | Andersen | 367/153 |
| 4,766,575 | 8/1988 | Ehrlich et al. | 367/153 |
| 4,786,837 | 11/1988 | Kalnen et al. | 310/364 |
| 4,789,971 | 12/1988 | Powers et al. | 367/157 |
| 4,805,157 | 2/1989 | Ricketts | 367/155 |
| 4,833,360 | 5/1989 | Holly | 367/155 |
| 4,833,659 | 5/1989 | Geil et al. | 367/155 |
| 5,044,053 | 9/1991 | Kopel et al. | 29/25.35 |
| 5,068,834 | 11/1991 | Fromont | 367/153 |
| 5,265,069 | 11/1993 | Wardle | 367/173 |
| 5,339,291 | 8/1994 | Libuha et al. | 367/153 |
| 5,367,500 | 11/1994 | Ng | 367/157 |

FOREIGN PATENT DOCUMENTS 317052 5/1989 European Pat. Off. .

*Primary Examiner*—Harold J. Tudor

*Attorney, Agent, or Firm*—Oblon, Spivak, McClelland, Maier & Neustadt

[57] ABSTRACT

An acoustic antenna includes at least one surface sensor formed by a stack of conducting materials and dielectric layers of piezo-electric material enclosed in a sheathing of flexible material. The assembly forms a flat panel 2 mounted against the hull 5 of a navel vessel and takes the shape of the hull. The mounting of the panel on the hull is achieved by two streamlined edging sections 3, 4 while leaving an intermediate water layer 6 remaining between the panel 2 and the hull 5. The sheathing includes an envelope of flexible material filled with a visco-elastic lining material and the piezo-electric material of the dielectric layers of the sensor is preferably a polyvinylidene fluoride film.

10 Claims, 4 Drawing Sheets

UNDERSEA ACOUSTIC ANTENNA WITH SURFACE SENSOR

Figure 1:
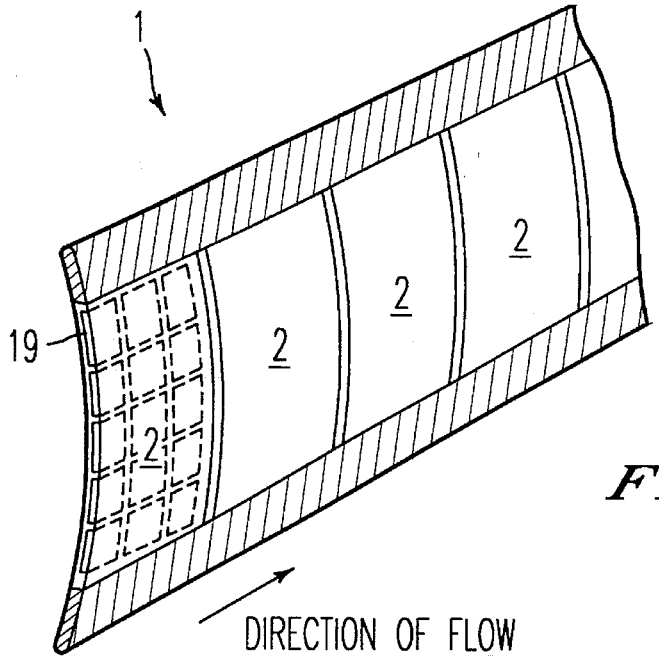

The present invention relates to an acoustic antenna for receiving low-frequency undersea waves.

Such an antenna is intended to detect and locate sources of undersea acoustic noise; in order to obtain good performance both in detection and in location, it is necessary to work over a low-frequency spectrum (by "low frequencies" will be understood frequencies lower than 2 kHz, typically lower than 1 kHz), and to make use of an antenna the gain of which is considerable so as to obtain a satisfactory signal/noise ratio (in numerous applications, a gain of 20 dB is necessary).

These two requirements (low frequencies and high gain) necessarily dictate antennae of considerable dimensions.

To that end, a first possibility consists in towing behind the naval vessel (ship or submarine) a streamer of hydrophones, thus forming a linear antenna of very great length.

Such a type of antenna may be much longer than the submarine and thus have very high performance at low frequency; it exhibits numerous drawbacks, however, in implementation (winch system, etc. and increase in the drag of the submarine) and above all a complete absence of directivity in the vertical plane by reason of the linear configuration of the streamer.

Another possibility consists in placing, over a large part of the length of the submarine, an antenna formed by an assembly of point sensors (hydrophones of small dimensions linked together in an appropriate way). It is thus possible to have available a two-dimensional array, which makes it possible to have directivity in the vertical plane and thus to locate the direction of the acoustic source in this plane.

This hydrophone-array antenna nevertheless exhibits a certain number of drawbacks:

- in the first place, it is necessary to decouple the various point sensors constituting the antenna acoustically with respect to the vibrations and resonances of the hull and of the attached structures of the submarine (especially vibrations and resonance originating from the machinery of the submarine) and from the hydrodynamic flow noise of the water on the sensors which, in the absence of appropriate decoupling, would produce a perturbing acoustic pressure masking the incident signal, generally of very low amplitude;
- it is also necessary to ensure leaktightness and a leaktight passage through the hull for each sensor;
- finally, the mechanical structures used to support the hydrophones often badly withstand the hydrodynamic forces to which they are subjected, in addition to the fact that they often cause troublesome disturbance to the flow of streams of water along the hull of the submarine.

In order to remedy these various drawbacks, the intention proposes an undersea acoustic antenna no longer produced from a set of point sensors, but from two surface sensors, typically of several tenths of a square meter of pick-up surface area each.

The use of essentially surface sensors would make it possible, by direct integration effect, to mask the major part of the parasitic or flow noises mentioned above, which would always be more or less picked up, previously, with the antennae formed from an assembly of point sensors.

It will also be seen that the antenna of the invention, despite its very large dimensions, only very slightly disturbs the hydrodynamic behaviour of the submarine, and further offers excellent resistance to hydrodynamic stresses and to impacts.

To this end, according to the invention, this acoustic antenna for receiving low-frequency undersea waves, includes at least one surface sensor formed by a stack of conducting layers forming electrodes and of dielectric layers of piezoelectric material interposed between these conducting layers, this sensor being enclosed in a sheathing of flexible material, the assembly thus constituted forming an attached flat panel mounted against the wall of the hull of a naval vessel, especially of a submarine, this panel exhibiting a degree of freedom in bending so as to allow it to follow the shape of this hull.

According to a certain number of advantageous characteristics:

- the sensor is subdivided into a plurality of elementary sensors the respective electrodes of which are electrically linked in parallel, the set of elementary sensors being placed in a common leaktight sheathing.
- the conducting layers of the elementary sensors are formed from a single strip machined in such a way as to divide it into separate elementary plates while leaving, between adjacent elementary plates, at least one bridge of material remaining, providing the electrical link between the electrodes of these various elementary sensors.
- the panel is mounted on the hull while leaving an intermediate water layer (6) between panel and hull, the thickness of this water layer being such that the distance separating the wall of the hull from the mid-plane of the sensor is less than a quarter of the wavelength of the maximum frequency of the operating band of the sensor.
- the sheathing of flexible material comprises an envelope of flexible material filled with a visco-elastic lining material, the visoelastic lining material preferably being a polyurethane material the behaviour of which is similar to that of water.
- the piezoelectric material of the dielectric layers of the sensor is a film of poly[vinylidene fluoride], the stack of conducting layers and of dielectric layers being preferably produced by bonding the polyvinylidene fluoride film onto the adjacent conducting layers.
- the material of the conducting layers is a copper-beryllium alloy.

Figure 2A:
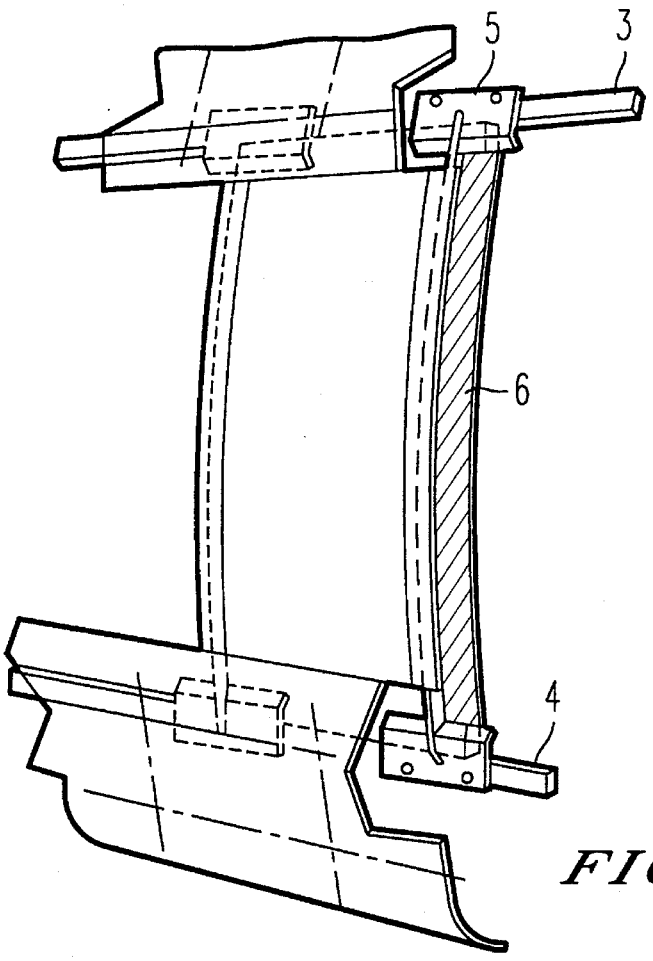
Figure 2B:
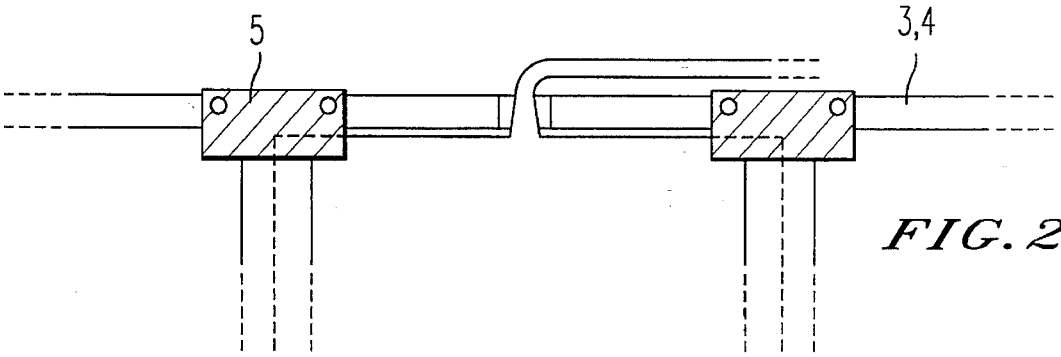
Figure 3:
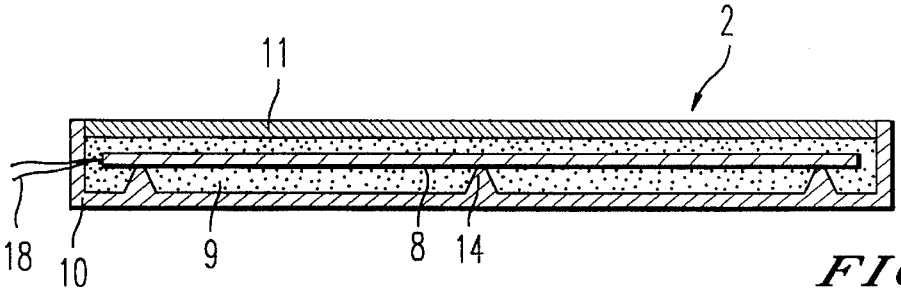
Figure 4:
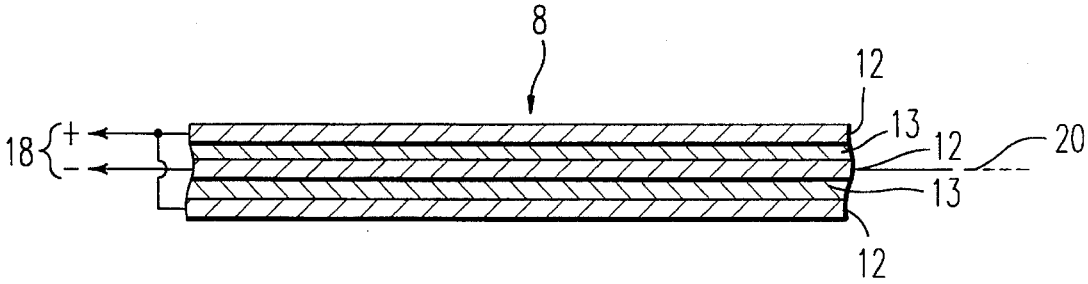
Figure 6:
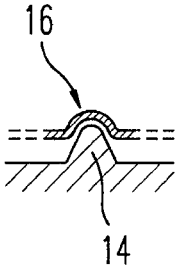
Figure 7:
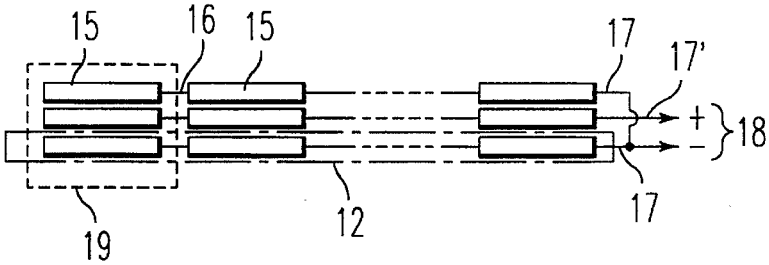
Figure 5:
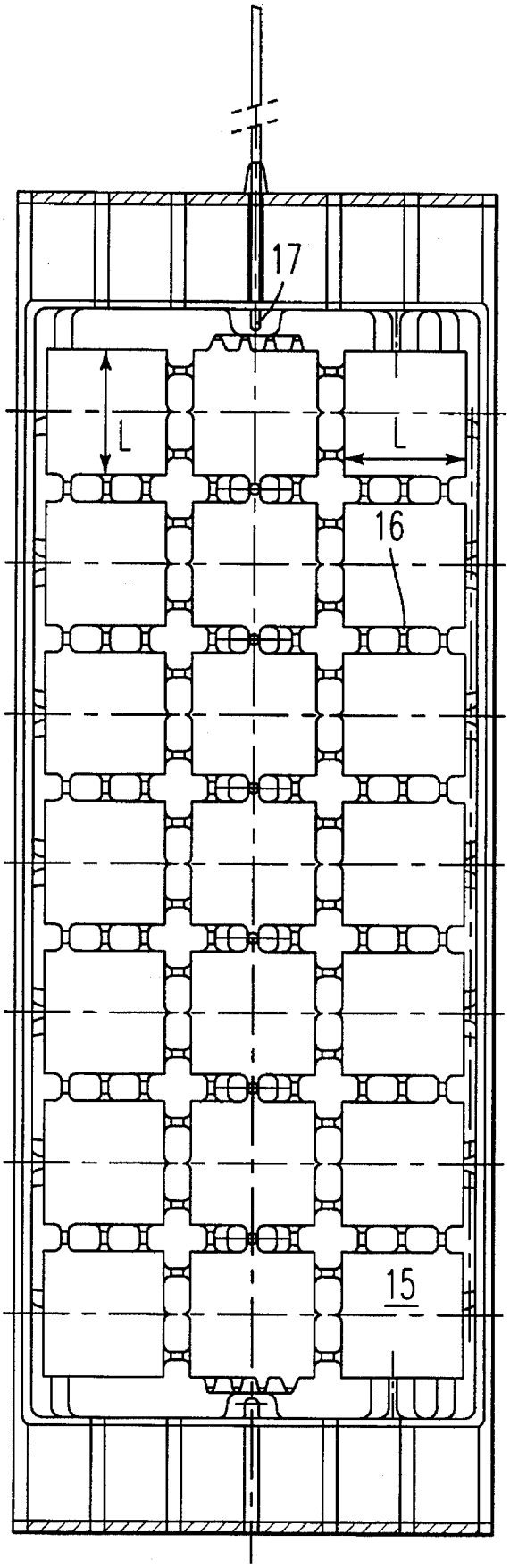

Other characteristics of the invention will appear on reading the detailed description below, given with reference to the attached drawings in which:

FIG. 1 is a general perspective view of an antenna according to the invention, formed by a plurality of detector panels, FIGS. 2*a* and 2*b* show one of the panels in place against the hull of the submarine, with the corresponding mounting means, FIG. 3 is a sectional view of one of the panels, FIG. 4 is a sectional view of the sensor proper, enclosed in the panel of FIG. 3, FIG. 5 is a plan view of one of the electrodes of the sensor of FIG. 4, FIG. 6 shows a detail of FIG. 5, and FIG. 7 shows the electrical connection diagram of the sensor of FIG. 4.

Figure 8:
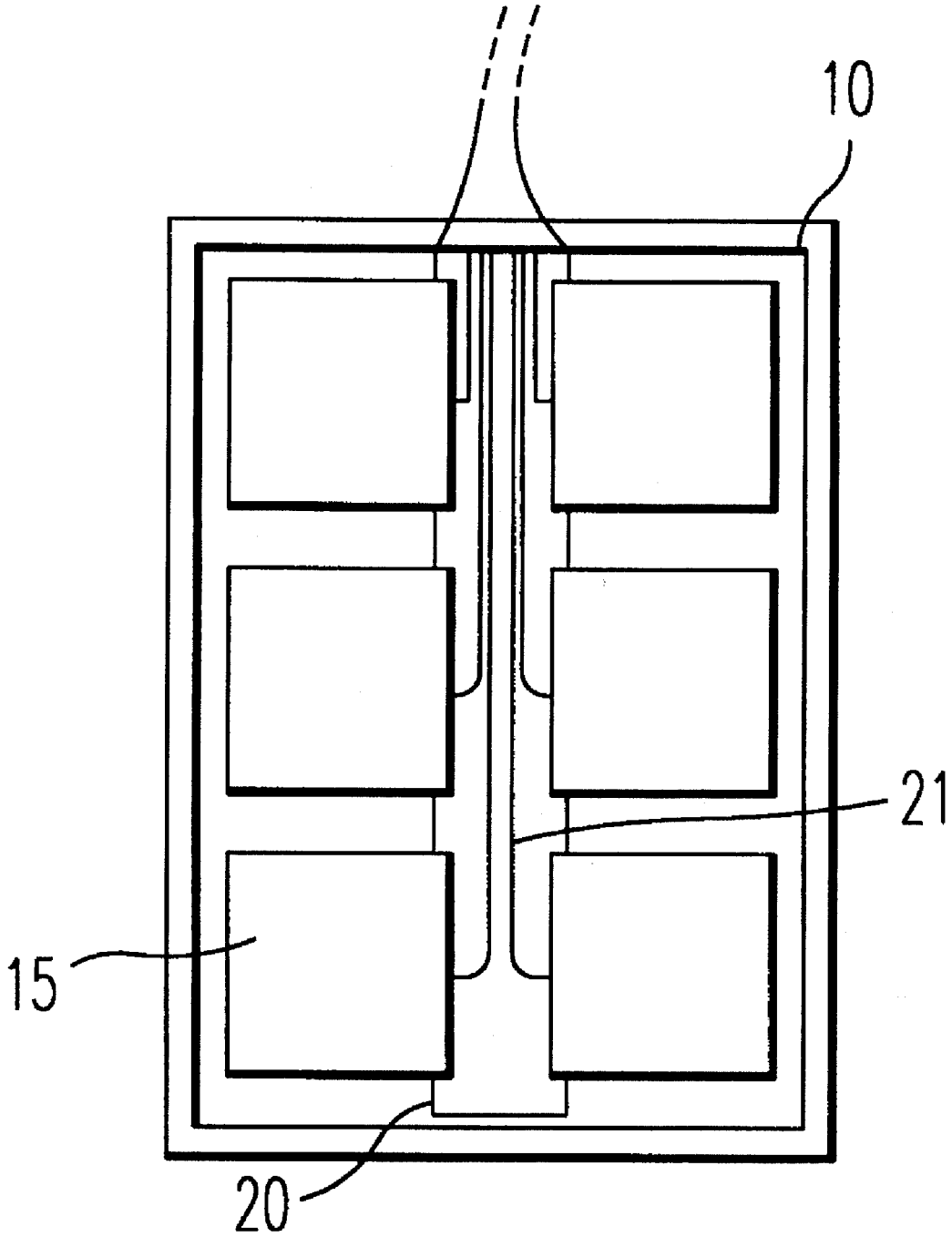

FIG. 8 is a plan view of the electrical connection of the sensors according to one variant.

FIG. 1 diagrammatically represents the antenna of the invention, referenced 1. This antenna is formed by a succession of panels 2, which each externally exhibit the shape of a relatively thin flexible plate, which is applied against the wall of the hull of the naval vessel (the hull of a submarine, or the submerged part of the hull of a surface ship) in such a way as to follow the shape of the hull.

The antenna 1 may thus consist of several tens of panels 2, for example sixty-four in number in one embodiment example; it therefore occupies a large part of each side wall of the submarine.

The dimensions of each panel are not critical; they may, for example, be given a height of the order of 1 m and a width (dimension in the direction of the flow, of the order of 0.5 m.

As to the thickness, it will be seen that the specific internal structure of the panels makes it possible, without difficulty, to give the latter a very slight thickness—without in any way prejudicing the performance of the sensor—, typically less that 10 cm.

In FIG. 2—*a*, the panel 2 has been represented mounted on the wall of the hull 5 of the submarine: the mounting is achieved by means of two rails 3 and 4 interacting with retaining pieces 5 or flanges.

On the sides the panels are fixed by means of T-sections. As represented in FIG. 2—*b*, the panels are held by clamping by means of 4 flanges mounted on the rails at the four corners. At the upper part of the panel, in its centre, is the overmoulded connector followed by the connections forming a cable.

The mounting is done leaving an intermediate water layer 6 providing mechanical decoupling between panels and hull.

The thin hull and each panel are connected together in such a way as to contribute minimum hydrodynamic disturbance.

Moreover, the electrical cables of the various panels 2 are routed under the thin hull above the upper rail allowing transmission of the signals detected by these panels 2.

The mounting of the panels on the side wall of the hull of the submarine is easy because, despite their considerable dimensions, their weight is relatively low having regard to the fact that, as will be seen later, they are composed of low-density materials and are easily curved to follow the shape of the hull of the submarine.

In the vertical plan, the large dimension of the panel (of the order of 1 m, as has just been indicated), confers a significant gain in directivity for the highest frequencies of the band.

Moreover, integration due to the large pick-up surface area reduces the sensitivity of the response to localized disturbances, leading to better phase control and to better track formation.

From the point of view of the enhancement of the signal/noise ratio, the large size of each panel compared with the correlation length of the flow noise may be noted, which makes it possible to have integration effect which reduces the sensitivity of the antenna to the flow noise.

In the same way, the bending waves propagated by the hull, the wavelength of which is smaller than the size of the panel, will be integrated, so that the sensitivity of the antenna to these waves will be reduced.

Finally, the compact structure of the antenna is not intrinsically resonant.

FIGS. 3 to 5 show the structure of the panel 2 in more detail.

In essence, each of the panels 2 consists (FIG. 3) of a surface sensor proper 8 embedded in a lining material 9 which is itself enclosed in an envelope 10, 11.

The surface sensor 8, the structure of which is represented in more detail in FIG. 4, is formed by an alternate stacking of conducting layers 12 and of piezoelectric dielectric layers 13.

The central electrode will constitute one of the poles of the sensor, while the two outer electrodes, linked in parallel, will constitute the other pole of the sensor, as indicated at 18. This structure makes it possible to achieve an electrical screening effect.

The metal layers are produced, for example, from a copper-beryllium alloy; the thickness of the metal electrode is of the order of 5/10 mm, for example. The blocking effect of the PVDF layers which results therefrom makes it possible to avoid it being depolarized at high temperatures >50° C.

The piezoelectric material of the dielectric layers is advantageously a polymer such as a polyvinylidene fluoride (PVDF), a fluorinated polymer which is well known for its piezoelectric properties; the PVDF layer has a thickness, for example, of the order of 0.5 to 1.5 mm.

PVDF, in addition to its piezoelectric properties, possesses the further advantage of excellent properties of chemical resistance and mechanical strength, low aging, etc, characteristic of most fluorinated thermoplastics.

According to one variant, the piezoelectric material of the dielectric layers is a copolymer, consisting, for example, of 70% of PVDF and of 30% of PTrFe (PolyTrifluoroethylene).

The PVDF film is advantageously produced according to the technology set out in FR-A-2 490 877, to which reference will be made for further details.

Briefly, this technology consists in continuously rolling a sheet of PVDF so as to draw it mechanically, while simultaneously applying a high electric field to it, making it possible to orient the dipole moments of the molecules and thus to polarize the material in order to give it its piezoelectric properties.

This PVDF film, cut up to the appropriate size, is bonded onto the metal electrodes so as to form the stack.

The sensor thus formed is next placed in a neoprene rubber envelope 10, which advantageously constitutes a mould (bottom and sides of the envelope). The bottom of this envelope is equipped with studs 14 obtained during its manufacture and on which is placed the sensor, which is thus positioned.

For the lining material 9, a "soft" polyurethane is used according to the invention. By "soft" polyurethane is understood a material the Shore hardness of which is typically less than 50. Its Poisson ratio is close to that of water 0.5. Moreover, its density acoustic propagation speed product is substantially equal to that of water, so as to be acoustically neutral with respect to the sensor. Its consistency is that of a viscous liquid.

The envelope 10 consists, for example, of a pack 10 making it possible to constitute a mould, as has just been indicated, in which the material 9 is moulded. The pack is then closed off by means of a "hard" polyurethane 11, typically one with a Shore hardness equal to 80.

The outer envelope 10, is, for example, a neoprene envelope of 30 mm in thickness.

The only limitation is that this material is not too rigid (in order not to transmit the stresses applied to the region of the link to the hull of the submarine) and that it is more elastic than the sensor proper.

In a variant, instead of a composite structure formed by an outer envelope enclosing a lining material, it would be possible to provide a homogeneous structure in which the sensor 8 were embedded in a homogeneous mass of appropriate material ("soft" polyurethane) exhibiting the necessary impermeability properties.

The thickness of the lining of the sensor 9 (that is to say of the leaktight envelope/viscoelastic lining assembly, or of the homogeneous mass in which the sensor will be embedded) must be chosen so as to exhibit a value making it possible:

on the inner side (hull side, sufficiently to space the sensor 8 away from the hull to limit the transmission of the bending waves of the hull towards the sensor.

This distance must however remain small compared with a quarter of the wavelength of the upper frequency of the frequency band used if it is desired to avoid any destructive interference between the incident signal and the signal reflected on the hull.

Thus, for a maximum frequency of 2 kHz, a quarter wavelength corresponds to 18.75 cm, so that the total distance between the mid-plane of the sensor 8 and the hull, that is to say the sum of the thickness of the lining 9 under the sensor, of the envelope 10 and of the layer of water 6 represented in FIG. 2, must remain markedly less than this value; in practice, a distance of 5 cm appears to be entirely suitable.

on the outer side (flow side), sufficiently to space the sensor 8 away from the surface over which the flow is taking place, that is to say the outer surface of the cover 11 of the leaktight envelope, to reduce the flow noises picked up to an acceptable level, having regard to the level of the incident signal, and thus to enhance the purity of the output signal delivered by the sensors.

FIG. 5 shows a particularly advantageous embodiment of the metal electrodes 12.

According to this embodiment, each of the electrodes 12 is formed by a plurality of square plates 15 linked together by thin bridges of material 16. This structure is produced, in a conventional way, by stamping of a strip of metal, for example, or by cutting out with a pressurized water jet.

Advantageously, the bridges 16, in addition to the fact that they provide the electrical continuity between the various plates 15, serve as elements for positioning the electrode 12 at the bottom of the envelope 10, by their shape in relief, illustrated in FIG. 6, which will allow the assembly to rest on the bottom of the envelope 10 on the studs 14 before pouring of the lining 10, keeping the plates 15 at an appropriate distance from the bottom of this envelope.

At one of the ends of this set of plates 15, an outlet 17 is provided, allowing electrical connection of the electrode.

The length L of the plates is chosen:

to be compatible with the width of the PVDF film which it is desired to produce (typically, continuous strips of about ten centimetres in width), and also to preserve a certain flexibility for the whole of the sensor, allowing it to follow the (variable) diameter of the hull of the submarine.

In fact, if the electrode 12 were formed by a uniform plate, its rigidity would make it difficult to shape the panel 2 to the profile of the hull of the submarine, whereas its separation into several plates 15 makes it possible to neutralize the rigidity of the metallic material itself.

Finally, a sensor formed by a monobloc electrode would risk being subject to natural resonance over this maximum dimension, which is of the same order of magnitude as the wavelengths of the frequencies picked up, whereas by dividing the panel into cells of smaller dimensions, the possible natural resonances occur always at frequencies lying far above the upper limit of the frequency band in question.

The electrical connection diagram is illustrated in FIG. 7, where it is seen that the various plates 15 are linked in parallel by the hinges 16, this assembly being electrically equivalent to a single electrode 12. The upper and lower electrodes are linked together by their connections 17, which form one of the poles of the sensor, while the connection 17' of the central electrode constitutes the opposite-polarity terminal of the sensor.

From the functional point of view, this assembly corresponds to a column-sensor formed by a plurality of elementary cells 19; these various cells being mounted in parallel, so that their electrical signals are added.

By way of example, the sensor 8 of each panel is formed by 21 plates of 105 mm side, arranged into 7×3 and spaced apart by 128 mm.

This embodiment example is not limiting. In fact, it is known that, in an antenna, it is advantageous to have a spacing between "sensors" equal to a half wavelength at the mean frequency of the band, so as not to be troubled by the image lobes.

In the example described, each sensor consists of a panel: this is not obligatory. There is a separation between the "physical" panel and the "electrical" sensor.

Thus, by cutting the bridges 16 between the columns and by linking to 3 outputs, 3 column sensors of 7 plates per panel are obtained. Conversely, adjacent panels may be linked in parallel, in order to form sensors spaced apart by several panel widths.

It is also possible to constitute an antenna formed by non-adjacent panels with "filling" panels between active panels, making it possible to preserve the hydrodynamic profile of the antenna.

The Applicant has also produced an antenna formed by 64 panels as described and capable of operating at carrier speeds of several tens of knots.

According to one embodiment variant, each elementary sensor 15 forms an independent sensor with an electrical outlet. In this case, each sensor 15 is electrically connected to the outlet cable.

Advantageously, the electrical connections are produced by means of a flexible printed circuit including tracks. A track arrives at a sensor by bonding the flexible circuit 20 to the edge between the central electrode and a PVDF layer, as indicated in FIG. 4.

The positioning studs 14 are placed under certain sensors, and the flexible circuit is thus also embedded in the lining material 9.

FIG. 8 represents an example of connection of 6 sensors according to this embodiment variant. The cut is along the central electrode, and the tracks correspond to the lines 21 on the strip 20.

Other connection diagrams with several flexible printed circuit strips are possible without departing from the context of the invention.

We claim:

1. An acoustic antenna structure for receiving low-frequency undersea waves, said structure including at least one surface sensor formed by a stack of conducting layers forming electrodes and of dielectric layers of piezoelectric material interposed between these conducting layers, said sensor being enclosed in a sheathing of flexible material, the assembly thus constituted forming an attached flat panel mounted against a wall of a hull of a naval vessel said panel exhibiting a degree of freedom in bending so as to allow it to follow the shape of this hull, characterized in that the panel is mounted on the hull while leaving an intermediate water layer between panel and hull, the thickness of this water layer being such that the distance separating the wall of the hull from a mid-plane of the sensor is less than a quarter of the wavelength of the maximum frequency of the operating band of the sensor in order to avoid destructive interference between said waves and said hull.

2. The antenna of claim 1, in which the sensor is subdivided into a plurality of elementary sensors, some of which have their respective electrodes electrically linked in parallel, the set of elementary sensors being placed in a common sheathing.

3. The antenna of claim 2, in which the conducting layers of the elementary sensors are formed from a single machined strip divided into separate elementary plates, with at least one bridge of material remaining between adjacent elementary plates, providing the electrical link between the electrodes of these various elementary.

4. The antenna of claim 3, in which the mounting of the panel on the hull is achieved by means of four flanges mounted on two rails positioned on the hull.

5. The antenna of claim 4, in which the sheathing of flexible material comprises an envelope of flexible material filled with a viscoelastic lining material.

6. The antenna of claim 5, in which the viscoelastic lining material is a polyurethane material with soft consistency, the Shore hardness of which is less than 50, of which the density-speed product, as well as the Poisson ratio, are close to that of water.

7. The antenna of claim 6, in which the piezoelectric material of the dielectric layers of the sensor is a film of polyvinylidene fluoride.

8. The antenna of claim 7, in which the stack of conducting layers and of the dielectric layers is produced by bonding the film of polyvinylidene fluoride onto the adjacent conducting layers.

9. The antenna of claim 8, in which the material of the conducting layers is a copper-beryllium alloy.

10. The antenna of claim 1, wherein said at least one sensor includes a plurality of independent sensors which are electrically linked by a flexible circuit.

* * * * *

UNITED STATES PATENT AND TRADEMARK OFFICE

CERTIFICATE OF CORRECTION

PATENT NO. : 5,517,467

DATED : May 14, 1996

INVENTOR(S) : Bernard Fromont et al.

It is certified that error appears in the above-indentified patent and that said Letters Patent is hereby corrected as shown below:

On the title page, Item [87], the PCT Information, should read:

--PCT Pub. No.: WO93/24244

PCT Pub. Date: Dec. 9, 1993--

Signed and Sealed this

Thirteenth Day of August, 1996

*Attest:*

Bruce Lehman

BRUCE LEHMAN

*Attesting Officer*

*Commissioner of Patents and Trademarks*